United States Patent [19]

Foglesonger et al.

[11] Patent Number: 4,998,584

[45] Date of Patent: Mar. 12, 1991

[54] HEAT EXCHANGER

[75] Inventors: John D. Foglesonger, Los Angeles; David M. Vranson, Canyon Country, both of Calif.

[73] Assignee: ITT Corporation, New York, N.Y.

[21] Appl. No.: 534,768

[22] Filed: Jun. 7, 1990

[51] Int. Cl.[5] ..... F28F 3/12

[52] U.S. Cl. ..... 165/171; 165/134.1; 165/180; 29/890.04

[58] Field of Search ..... 29/890.04; 165/168, 165/170, 171, 180, 134.1

[56] References Cited

U.S. PATENT DOCUMENTS

| | | | |
|---|---|---|---|
| 3,193,659 | 7/1965 | Schaus | 29/890.04 X |
| 4,178,990 | 12/1979 | Popplewell | 165/134.1 |
| 4,620,507 | 11/1986 | Saito et al. | 122/6 B |
| 4,823,742 | 4/1989 | Davis et al. | 122/7 R |
| 4,852,645 | 8/1989 | Coulon et al. | 165/180 |
| 4,853,539 | 8/1989 | Hall et al. | 250/288 |
| 4,898,465 | 2/1990 | Crawford et al. | 356/311 |
| 4,930,317 | 6/1990 | Klein | 62/3.3 |

FOREIGN PATENT DOCUMENTS

| | | | |
|---|---|---|---|
| 55-49641 | 4/1980 | Japan | 165/171 |
| 59-125228 | 7/1984 | Japan | 29/890.04 |
| 292484 | 12/1928 | United Kingdom | 165/171 |
| 769969 | 3/1957 | United Kingdom | 165/171 |

*Primary Examiner*—Martin P. Schwadron
*Assistant Examiner*—Allen J. Flanigan
*Attorney, Agent, or Firm*—Thomas N. Twomey

[57] ABSTRACT

A method of forming and apparatus for a heat exchanger having a body of aluminum alloy having two sides with a groove machined in the body in the shape of a heat exchange tubing but of a dimension larger than the tubing. The tubing is placed in the groove and the space between the tubing and the groove is filled with boron nitride whereby corrosion problems are minimized and heat transfer enhanced. The method includes the steps of forming the cavity in at least one side of the body for inserting a tubing of a dimension less than the cavity, precoating the tubing in the cavity by spraying with boron nitride powder in a carrier, placing the heat exchange tubing in the cavity and filling the space between the wall of the cavity and the tubing with boron nitride powder, and bonding the two sides together.

7 Claims, 2 Drawing Sheets

HEAT EXCHANGER

BACKGROUND OF THE INVENTION

1. Field of the Invention

The present invention relates to a heat exchanger and more particularly to a heat exchanger and method for making employing boron nitride powder between the heat exchange tubing and the body of the exchanger.

2. Description of the Prior Art

In the prior art a stainless steel tubing has been employed embedded in an aluminum casting such as aluminum alloy 356-T5 and machined to a final form. The disadvantages of this is that the castings are porous and it is difficult to predict as to where porosity will occur. The casting alloys are less thermally conductive than for instance aluminum alloy 6061T6. Stainless steel tubing is less thermally conductive than copper tubing and the yield from such a process is quite low resulting in a high cost.

U.S. Pat. No. 4,852,645 Coulon, et al. discloses a heat transfer device for use between two materials which have different expansion coefficients. The thermal transfer layer comprises expanded graphite, for example, inserted between the materials which are selected from among carbonaceous materials, ceramics and metal or metal alloys. The expanded graphite is either inserted in the form of a rolled or compressed sheet or is compressed in place. Coulon forms the structure by forming at least one semicircular passage in each element. He discloses the use of silicon nitride which only has the thermal conductivity of 19 BTUs×ft/(hr×ft$^3$×° F.) to 105 BTUs×ft/(hr×ft$^3$×° F.) for boron nitride and his device is for use in applications such as chemical reactors, combustion devices or continuous casting of molten metals.

U.S. Pat. No. 4,024,620 Torcomian discloses the use, such as in FIG. 7, of filling a space between conductors 100 and 102 and 94 with metal wool fibers such as 98. Also FIG. 4 discloses the use of putting the two cooling coils 72 and 74 into the structure 66 and clamping them with walls 76 and 78.

U.S. Pat. No. 4,217,954 Vincent and U.S. Pat. No. 4,162,061 Buehler, et al. disclose a plurality of different layers between a cooling tube and the body.

A method of constructing a heat exchanger out of three pieces with an embedded tube surrounded by a conductive material is partially disclosed in Smith, U.S. Pat. No. 1,982,075 which shows a tube 27 in FIGS. 6 and 7 enclosed between 21 and 24 and conformed to fit but does not disclose any material therebetween such as boron nitride. Wittel, U.S. Pat. No. 4,583,583, discloses a similar structure using a teflon tube.

It is accordingly an object of the present invention to provide an improved heat exchanger which may employ an aluminum alloy other than a casting.

Another object of the invention is to provide such a heat exchanger containing boron nitride between the heat exchange tubing and the body.

A still further object of the present invention is to provide a method for forming such a heat exchanger.

SUMMARY OF THE INVENTION

The foregoing and other objects are accomplished by providing a heat exchanger formed from a body of aluminum alloy having two sides with a groove machined in the body in the shape of the heat exchange tubing but of a dimension larger than the tubing. The tubing is placed in the groove and the space between the tubing and groove is filled with boron nitride.

Another aspect of the invention is the method of forming the heat exchanger which includes steps of forming a cavity in at least one side of a body of aluminum alloy for inserting a heat exchanger tubing of a dimension less than the cavity. The tubing and cavity are then precoated by spraying with boron nitride powder in a carrier. The tubing is placed in the cavity and the space between the wall of the cavity and tubing is filled with boron nitride powder in a solvent such as alcohol. The device is then ultrasonically shaken and vacuum evacuation is used to remove any air in the interface between the tubing and the body, any remaining solvent being baked off. The two sides are then bonded together.

Other objects, features and advantages of the invention will become apparent from a reading of the specification when taken in conjunction with the drawings.

DETAILED DESCRIPTION OF PREFERRED EMBODIMENT

Figure 1:
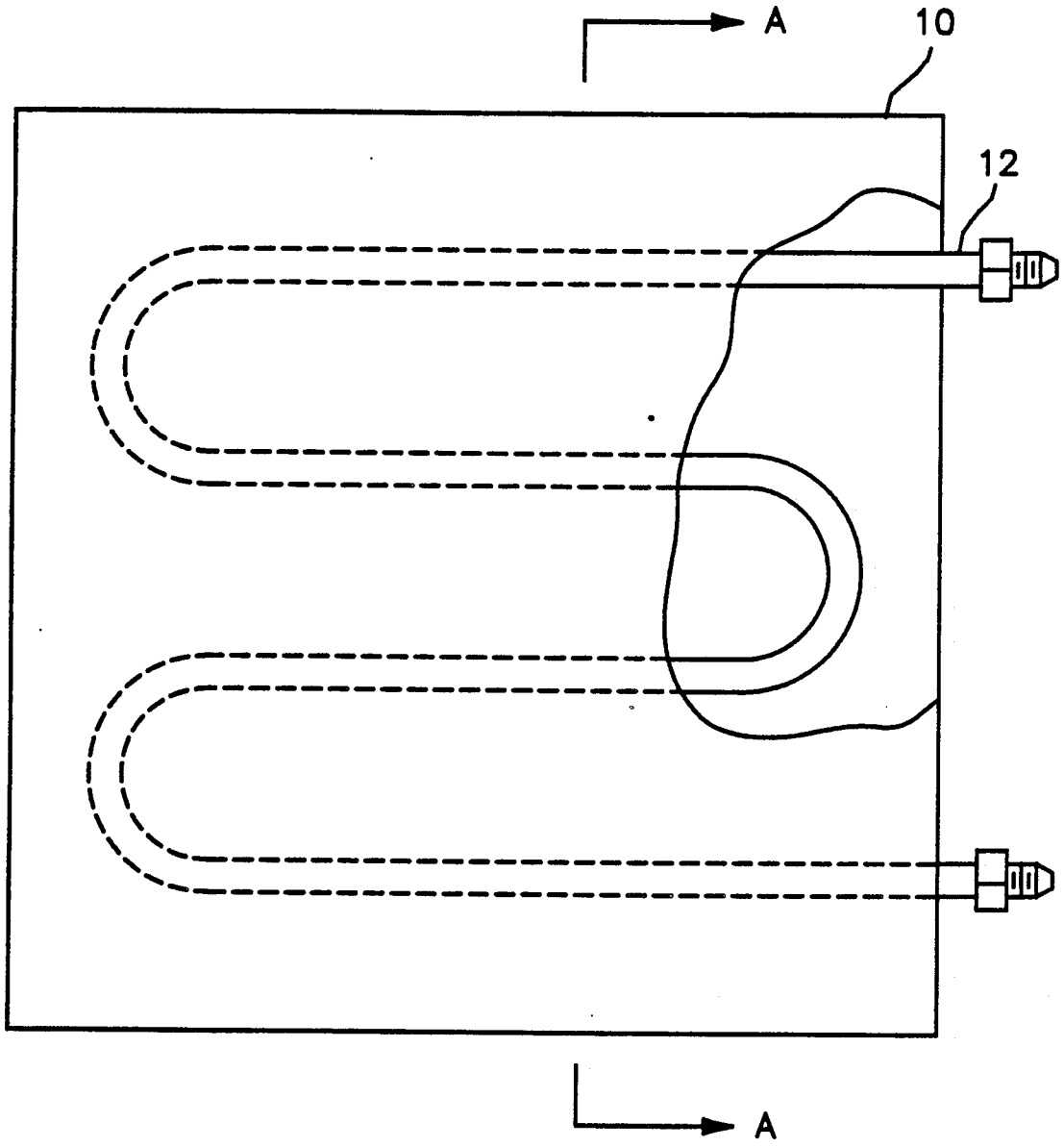
FIG. 1 illustrates a top view of a heat exchange device showing the placement of the tubing in the body partly broken away.
Figure 2:
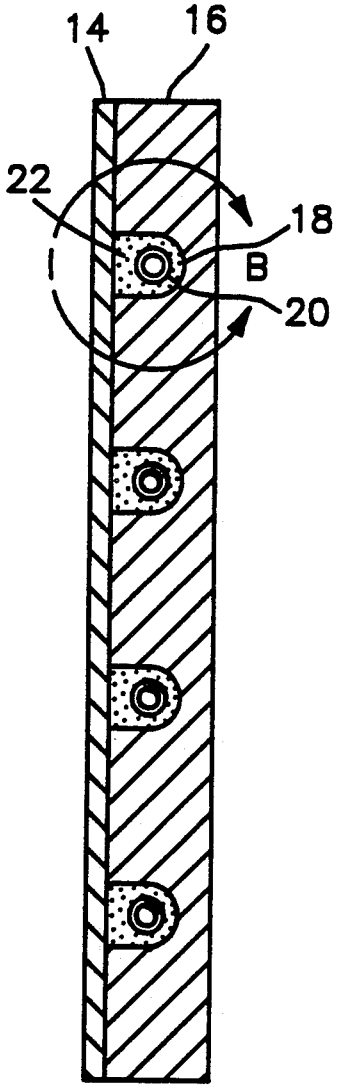
FIG. 2 is a section taken along A of FIG. 1 showing the two sides of the body and illustrating the boron nitride around the tubing which is not shown in FIG. 1.

Turning now to the drawings the improved heat exchanger has a configuration such as shown in FIG. 1 in which a body 10 has a cooling tubing 12 contained therein. FIG. 1 does not illustrate the boron nitride between the tubing 12 and the body 10. This is shown in FIG. 2 in which the body 10 has two sides 14 and 16 in which grooves 18 are machined. The body 10 may be made from an aluminum alloy such as 6061T6 aluminum which has an advantage over castings previously used in that it does not have the porosity of the castings which result in problems such as decreased conductivity and yield. Also casting alloys are less conductive thermally by about 25%, the 6,000 series of aluminum alloys having a conductivity of 125 BTU's×ft/hr×ft$^2$×°F., where BTU equals British Thermal Unit, °F. equals degrees Fahrenheit, ft equals feet, and hr equals hours. Aluminum casting alloys have a thermal conductivity of 92.5. The groove 18 may be machined conveniently in the half of the body 16 to a dimension larger than that of the tubing 20 which in this case may be a copper alloy tube having a conductivity of 226 as opposed to a stainless steel tube of the prior art having a conductivity of 9.4.

Figure 3:
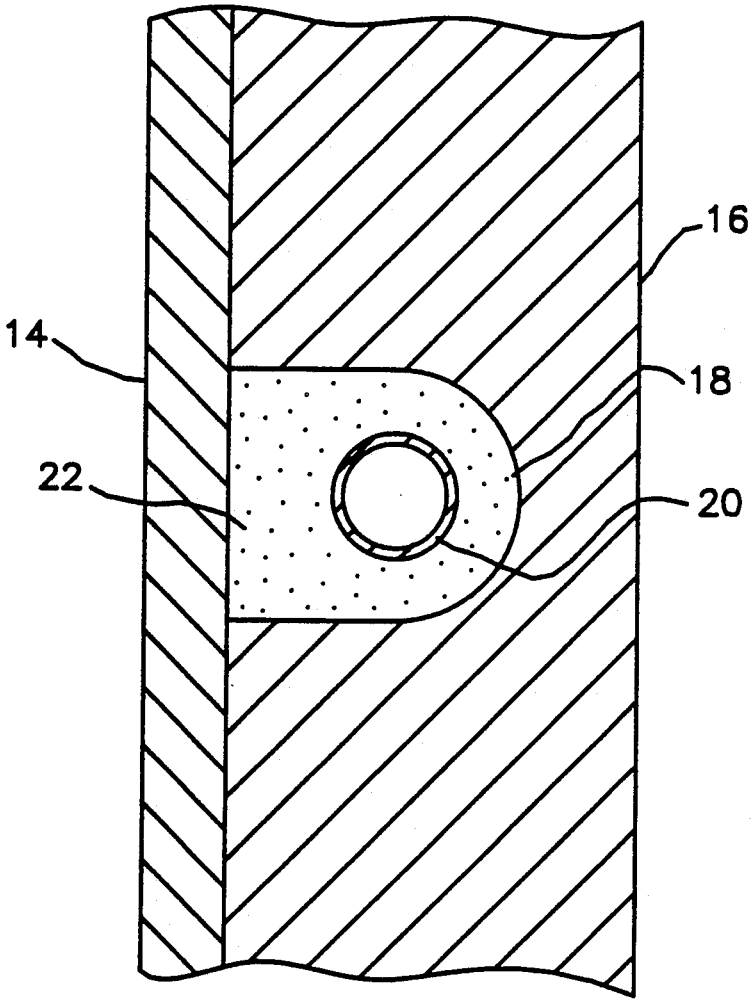
FIG. 3 is an enlargement of the area detail B of FIG. 2 showing aspects of the invention in more detail.

The space between tubing 20 and groove 18 is filled with a boron nitride powder 22. This is all shown in more detail in FIG. 3. The halves 14 and 16 are then torqued together using an adhesive bonding for strength and aluminum rivets to prevent peeling. No final machining step is required. The boron nitride powder is charged with a carrier such as alcohol to ensure packing which may be baked off after ultrasonic shaking and vacuum evacuation of any air in the powder prior to torquing together of the sides 14 and 16. The tube 20 and channel 18 are pretreated with boron nitride spray to ensure proper thermal coupling from a clean copper tube to a clean aluminum surface, the copper tube having been cleaned with a mild acid such as citric acid and a degreaser and the aluminum cavity precleaned with a weak acid such as diluted nitric acid. A boron nitride aerosol spray is provided by Union Carbide under the designation HPC Coating, catalog number H-3201. The resulting tight packing of the boron nitride will reduce corrosion and enhance heat transfer.

In the method of forming the heat exchanger some or all of the following steps may be employed. A cavity is formed in at least one side of a body of aluminum alloy for inserting a heat exchange tubing of a dimension less than the cavity. A copper alloy heat exchange tubing is precleaned using a mild acid such as citric acid and a degreaser. The aluminum cavity is precleaned with a weak acid such as nitric. The tubing and cavity are precoated by spraying with a boron nitride powder in a carrier. The heat exchange tubing is placed in the cavity. The space between the wall of the cavity and tubing are filled with a boron nitride powder in a solvent such as alcohol. Ultrasonic shaking and vacuum evacuation is used to remove any air in the interface between the tubing and the body and any remaining solvent is baked off. The two sides are then bonded together employing adhesive bonding for strength and riveting of the two sides to prevent pealing.

Since the principles of the invention have now been made clear, modifications which are particularly adapted for specific situations without departing from those principles will be apparent to those skilled in the art. The appended claims are intended to cover such modifications as well as the subject matter described and to only be limited by the true spirit and scope of the invention.

What is claimed as new and desired to be secured by Letters Patent of the United States is:

1. A method of forming a heat exchanger including the steps of, forming a cavity in at least one side of a body of aluminum alloy for inserting a heat exchange tubing of a dimension less than the cavity, precoating the tubing and cavity by spraying with boron nitride powder in a carrier, placing the heat exchange tubing in the cavity, filling the space between the wall of the cavity and the tubing with boron nitride powder in a solvent such as alcohol and bonding the two sides together.

2. The method of claim 1, including the steps of machining the body in two sides out of 6061T6 aluminum alloy, machining the cavity to a depth greater than the tubing dimension.

3. The method of claim 2 including the steps of using copper alloy heat exchange tubing, precleaning the copper tubing with a mild acid such as citric acid and a degreaser, and precleaning the aluminum cavity with a weak acid such as diluted nitric acid.

4. The method of claim 3 including the steps of ultrasonic shaking and vacuum evacuation of any air in the interface between the tubing and the body and baking off any remaining solvent.

5. The method of claim 4 including the steps of bonding the two sides employing adhesive bonding for strength and riveting the two sides together to prevent peeling.

6. A heat exchanger formed from a body of aluminum alloy having two sides, a heat exchange tubing, a groove machined in the body in the shape of said heat exchange tubing but of a dimension larger than said tubing, boron nitride filling the space between the tubing and the body sides which are bonded together whereby corrosion problems are minimized and heat transfer is enhanced.

7. The heat exchanger of claim 6 in which said tubing is of a copper alloy.

* * * * *